US007352987B2

(12) United States Patent
Iwata et al.

(10) Patent No.: US 7,352,987 B2
(45) Date of Patent: Apr. 1, 2008

(54) FIXING DEVICE AND IMAGE FORMING APPARATUS FOR HOLDING A RECORDING MEDIUM BY ELECTROSTATIC FORCE

(75) Inventors: Naoki Iwata, Saitama (JP); Hiromasa Takagi, Tokyo (JP); Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 668 days.

(21) Appl. No.: 10/733,242

(22) Filed: Dec. 12, 2003

(65) Prior Publication Data

US 2004/0179875 A1 Sep. 16, 2004

(30) Foreign Application Priority Data

Dec. 13, 2002 (JP) ..... 2002-362673
Nov. 10, 2003 (JP) ..... 2003-380096

(51) Int. Cl.
*G03G 15/20* (2006.01)

(52) U.S. Cl. ..... 399/329

(58) Field of Classification Search ..... 399/329, 399/400, 214, 221, 67
See application file for complete search history.

(56) References Cited

U.S. PATENT DOCUMENTS 5,172,169 A 12/1992 Takashima et al.
5,214,478 A * 5/1993 Honma et al.
5,220,383 A 6/1993 Enoki et al.
5,239,344 A 8/1993 Enoki et al.
5,241,357 A 8/1993 Iwata
5,245,391 A 9/1993 Suzuki et al.
5,286,918 A 2/1994 Iwata et al.
5,311,263 A 5/1994 Suzuki et al.
5,315,061 A 5/1994 Suzuki et al.
5,339,141 A 8/1994 Suzuki et al.
5,424,814 A 6/1995 Suzuki et al.
5,450,172 A 9/1995 Suzuki et al.
5,451,713 A 9/1995 Suzuki et al.
5,474,869 A 12/1995 Tomita et al.
5,502,552 A 3/1996 Iwata et al.
5,527,657 A 6/1996 Takeda et al.
5,541,029 A 7/1996 Iwata et al.
5,557,392 A 9/1996 Iwata
5,674,408 A 10/1997 Suzuki et al.
5,741,616 A 4/1998 Hirano et al.
5,809,386 A 9/1998 Iwata (Continued)

FOREIGN PATENT DOCUMENTS

JP 61205968 A * 9/1986

(Continued)

OTHER PUBLICATIONS

U.S. Appl. No. 11/333,435, dated Jan. 18, 2006, Tomita et al.

*Primary Examiner*—Susan Lee
(74) *Attorney, Agent, or Firm*—Oblon, Spivak, McClelland, Maier & Neustadt, P.C.

(57) ABSTRACT

A fixing device includes a pressure belt that holds a recording medium by electrostatic force and carries the recording medium. The recording medium has a toner image on a surface that is not in contact with the endless pressure belt. A fixing belt fixes the toner image on the recording medium that is held by the pressure belt.

20 Claims, 5 Drawing Sheets

U.S. PATENT DOCUMENTS

| | | | | |
|---|---|---|---|---|
| 5,812,917 | A | 9/1998 | Iwata et al. | |
| 5,869,213 | A | 2/1999 | Iwata et al. | |
| 6,284,424 | B1 * | 9/2001 | Iimura et al. | |
| 6,370,350 | B2 | 4/2002 | Tomita | |
| 6,370,352 | B1 | 4/2002 | Tomita | |
| 6,413,690 | B2 | 7/2002 | Tomita | |
| 6,455,217 | B2 | 9/2002 | Tomita | |
| 6,492,084 | B2 | 12/2002 | Tomita | |
| 6,505,016 | B2 | 1/2003 | Tomita | |
| 6,519,439 | B2 | 2/2003 | Tomita | |
| 6,623,897 | B2 | 9/2003 | Tomita | |
| 6,653,039 | B2 | 11/2003 | Tomita | |
| 6,733,943 | B2 * | 5/2004 | Finn et al. | |
| 6,882,820 | B2 * | 4/2005 | Shinshi et al. | |
| 2002/0031363 | A1 * | 3/2002 | Tomita et al. | 399/329 |
| 2004/0179875 | A1 | 9/2004 | Iwata et al. | |

FOREIGN PATENT DOCUMENTS

| | | | | |
|---|---|---|---|---|
| JP | 63191157 | A | * | 8/1988 |
| JP | 02306262 | A | * | 12/1990 |
| JP | 5-19646 | | | 1/1993 |
| JP | 5-127551 | | | 5/1993 |
| JP | 05150679 | A | * | 6/1993 |
| JP | 05249853 | A | * | 9/1993 |
| JP | 09068880 | A | * | 3/1997 |
| JP | 10-221982 | | | 8/1998 |
| JP | 10228190 | A | * | 8/1998 |
| JP | 2000-19866 | | | 1/2000 |
| JP | 2000-89593 | | | 3/2000 |
| JP | 2002-365948 | | | 12/2002 |

* cited by examiner

FIXING DEVICE AND IMAGE FORMING APPARATUS FOR HOLDING A RECORDING MEDIUM BY ELECTROSTATIC FORCE

CROSS-REFERENCE TO RELATED APPLICATIONS

The present document incorporates by reference the entire contents of Japanese priority documents, 2002-362673 filed in Japan on Dec. 13, 2002 and 2003-380096 filed in Japan on Nov. 10, 2003.

BACKGROUND OF THE INVENTION

1) Field of the Invention

The present invention relates to an image forming apparatus that uses the principle of electrophotography for forming images, and more particularly to a fixing device in the image forming apparatus.

2) Description of the Related Art

There has been a growing requirement for saving natural resources and reducing energy consumption. For example, in image forming apparatuses that use the principle of electrophography for forming images, there is a tendency to find out a structure that enables reduction in power consumption. Particularly, the process of fixing (hereinafter, "fixing") an image to a recording medium requires a lot of power to heat a fixing device to a considerably higher temperature. Therefore, if the fixing can be performed at lower temperature, there is a possibility to achieve reduction in power consumption.

Conventionally, the fixing is performed at a high temperature from 150 degrees to 200 degrees and it takes about one to five minutes to warm a fixing device from a room temperature. If the fixing can be performed at a temperature of 150 degrees or less, and more preferably at a temperature of around 100 degrees, it is possible to heat the fixing device with a lower power as well as warm the fixing member in a shorter time.

A softening point or a melting point of a toner has to be less than 100 degrees to achieve the fixing at a low temperature. The toner is a resin, which is an organic polymer. Generally, if the melting point of the organic polymer is low, its melt viscosity is also low. Moreover, a resin with a low molecular weight has a low melt viscosity, because, an interaction between molecules is weak. However, when the toner has a low melting point, during the fixing, the viscosity of the toner decreases abruptly as the temperature rises above the melting point of the toner so that a part of a molten toner on a recording medium adheres to a surface of a fixing roller, thereby causing an offset in the image.

One approach to prevent the offset is to use a fixing belt. The molten toner on the recording medium is made to make a contact with the fixing belt. As a result, the molten toner gets cooled and the toner coagulates so that the toner does not get adhered to the fixing belt.

However, when the fixing belt is used, to ensure stable heating of the toner and radiation of heat from the toner, it is necessary to apply pressure to the fixing belt while the toner on the recording medium is in contact with the fixing belt. If the pressure is applied is high, the fixing device requires more power to drive the fixing belt, because, a driving torque increases. On the other hand, if the pressure applied is low, a contact between the recording medium and the fixing belt becomes weak, resulting in faulty fixing such as image blurring.

Japanese Patent Application Laid Open No. H5-19646 discloses a fixing device with a cooling fan to blow a fresh air onto a surface of an endless belt (i.e., the fixing belt). A molten toner on a recording medium gets cooled faster by the fresh air and coagulates. However, a driving torque increases because of the pressure of a press-contacting roller. Moreover, it is difficult to keep a tight contact between the recording medium and the endless belt until the toner gets cooled.

Japanese Patent Application Laid Open No. H110-221982 discloses a fixing device that includes an endless fixing belt, a guiding roller, a pressure roller, a paper pressing roller, and a heating means. The guiding roller is provided at one end of a carrying path for a recording medium, and the pressure roller is provided at another end. The paper pressing roller presses the paper against the fixing belt. However, in this structure, a driving torque increases because of the pressure of these rollers, moreover, image blurring occurs because it is difficult to keep a tight contact between the recording medium and the fixing belt in a position where no rollers is present.

Japanese Patent Application Laid Open No. 2000-89593 discloses a fixing device that includes a heating roller, a fixing roller, a fixing belt extended between the fixing roller and the heating roller, and a pressure roller that presses the fixing belt from below. The fixing roller and the heating roller are respectively held in contact with the pressure roller across the fixing belt so that a nip is formed from a contact point between the fixing roller and the pressure roller to a contact point between the heating roller and the pressure roller. However, in this structure, a driving torque increases with pressure of these rollers, moreover, an image blurring occurs due to a curvature within the nip while a recording medium is being carried on the fixing belt.

Japanese Patent Application Laid Open No. H5-127551 and Japanese Patent Application Laid Open No. 2002-365948 disclose a fixing device that has a pair of belts. However, inventors of the present invention confirmed in an experiment that this fixing device produces blurred images because of undulations on a surface of the belt. Precisely, if one of the belts has the undulation on the surface, a recording medium fluctuates between both of the belts repeatedly, thereby causing the image blurring because of wrinkles on the recording medium.

Japanese Patent Application Laid Open No. 2000-19866 discloses a fixing device in which a recording medium adheres to a fixing belt because of an electrostatic force. This structure enables uniform and effective transfer of heat from the fixing belt to the recording medium.

SUMMARY OF THE INVENTION

It is an object of the present invention to solve at least the problems in the conventional technology.

A fixing device in an image forming apparatus according to one aspect of the present invention includes a pressure belt that holds a recording medium by electrostatic force and carries the recording medium, the recording medium having a toner image on a surface that is not in contact with the pressure belt; and a fixing belt that fixes the toner image on the recording medium that is held by the pressure belt.

An image forming apparatus according to the present invention includes the fixing device according to the above aspect.

The other objects, features, and advantages of the present invention are specifically set forth in or will become apparent from the following detailed descriptions of the invention when read in conjunction with the accompanying drawings.

DETAILED DESCRIPTION

Exemplary embodiments of a fixing device and an image forming apparatus according to the present invention are described in detail below referring to the accompanying drawings.

Figure 1:
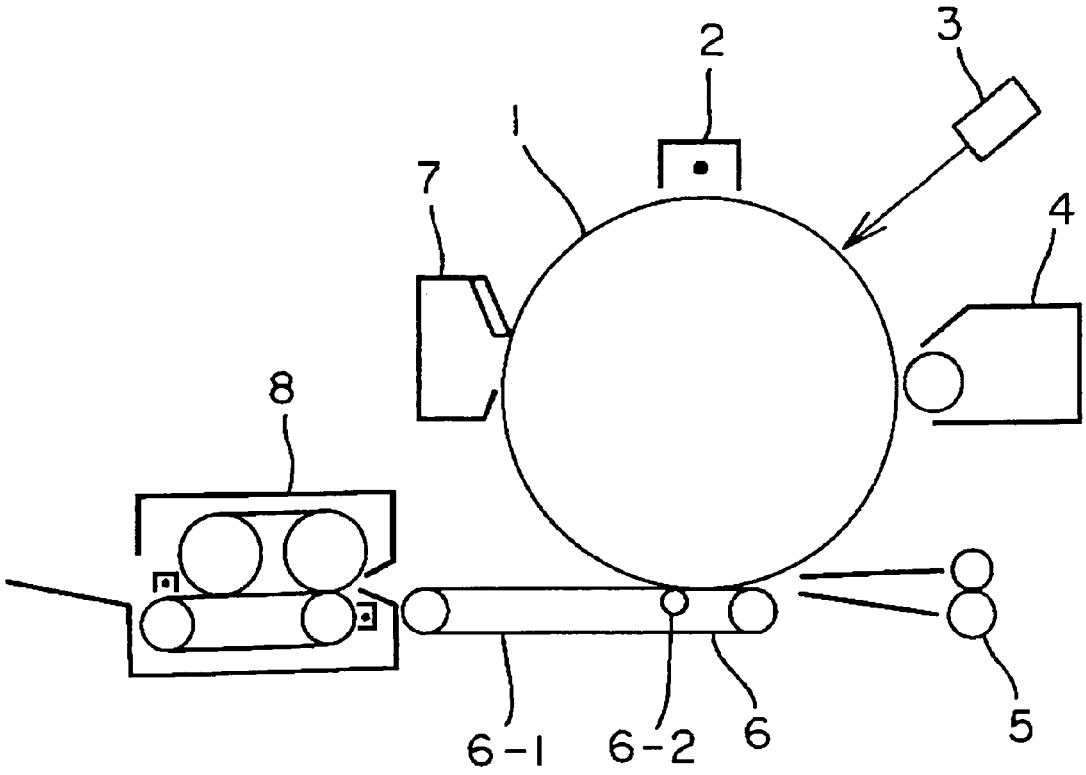
FIG. 1 is a schematic diagram of an image forming apparatus according to an embodiment of the present invention.

FIG. 1 is a schematic diagram of an image forming apparatus according to an embodiment of the present invention. In this image forming apparatus, a charging device 2 uniformly charges a surface of a photoreceptor drum 1, a semiconductor laser-emitting device 3 emits a laser light on the surface of the photoreceptor drum 1 to form a latent image on the photoreceptor drum 1. A developing device 4 develops the latent image on the photoreceptor drum 1 to form a toner image. During the developing process, the developing device 4 sprays onto the surface of the photosensitive drum 1 a toner that is charged by friction. A feeding unit 5 feeds a recording medium between the photosensitive drum 1 and a transfer-carrying belt 6. As a result, the toner image is transferred from the photoreceptor drum 1 to the recording medium. Assuming that the toner has a negative charge, a transfer electrode 6-2 applies a positive charge to the transfer-carrying belt 6. The recording medium also gets positively charged because of the positive charge on the transfer-carrying belt 6. The recording medium is then carried to a fixing device 8. A cleaning device 7 removes any traces of toner remaining on the photoreceptor drum 1.

Figure 2:
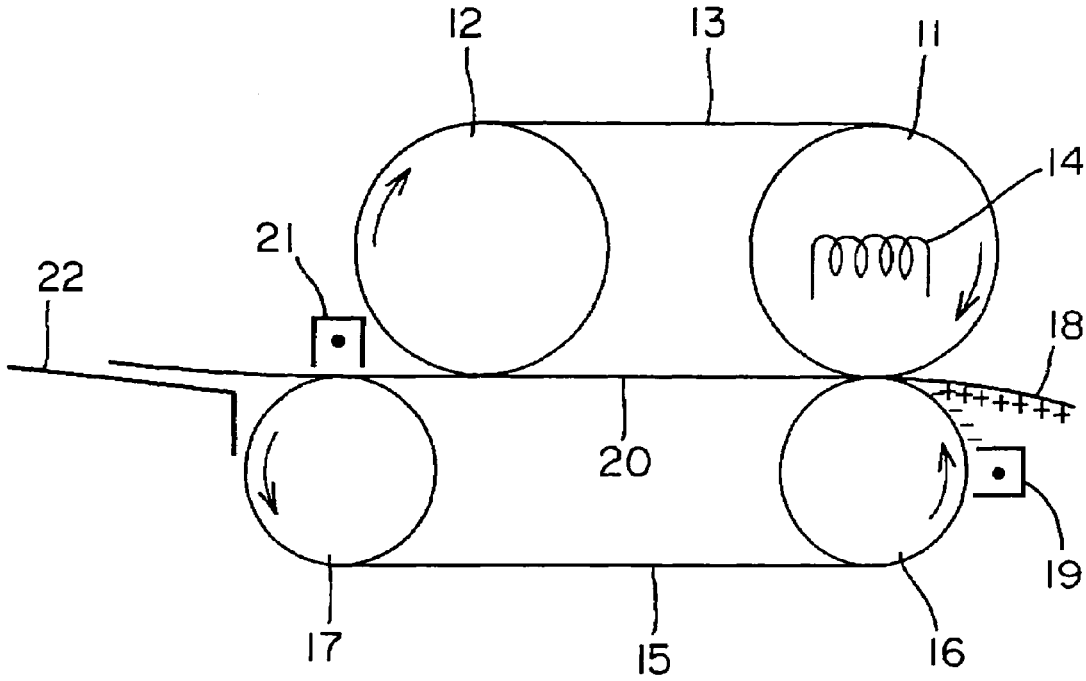
FIG. 2 is a schematic diagram of a fixing device according to an embodiment of the present invention.

FIG. 2 is a schematic diagram of the fixing device 8. An endless fixing belt 13 is suspended between a heating roller 11 and a guide roller 12. The fixing belt 13 is made of polyimide film, is electrically conductivity, and has a thickness of 50 micrometers. The heating roller 11 has a heater 14 inside. The heater 14 heats the fixing belt 13 to a predetermined temperature. A pressure belt 15 is suspended between guide rollers 16 and 17. The pressure belt 15 is made of polyimide film, is made of electrically non-conducting material, and has a thickness of 80 micrometers. The pressure belt 15 makes a tight contact with the fixing belt 13; therefore, the pressure belt 15 rotates when the fixing belt 13 rotates. A recording medium 1.8 is fed between the fixing belt 13 and the pressure belt 15. Just before the recording medium is fed between these belts, a charger 19 applies a negative charge to a surface of the pressure belt 15 while the guide roller 16 is grounded. Therefore, the surface of the pressure belt 15 is charged to a potential from about minus 500 volts to minus 1000 volts. Because the recording medium 18 is positively charged in a transferring process and the pressure belt 15 has a negative charge, the recoding medium 18 sticks firmly to the pressure belt 15 while it is transported by the fixing belt 13 and the pressure belt 15. In other words, the recording medium 18 does not fluctuate between the pressure belt 15 and the fixing belt 13.

Because the pressure belt 15 makes a close contact with the fixing belt 13 and because the fixing belt 13 is hot, the toner on the recording medium, which is sandwiched between the pressure belt 15 and the fixing belt 13, melts. A suctioning and feeding unit 20 cools the toner so that the toner sticks to the recording medium 18. As a result, the toner does not stick to the fixing belt 13. The recording medium 18 is suctioned to the pressure belt 15 so as not to twine to the fixing belt 13.

FIG. 2 illustrates a case in which a surface (front surface) of the pressure belt that makes a contact with the recording medium is charged, however, a surface (back surface) of the pressure belt that does not make a contact with the recording medium may be charged. This approach is preferable when a surface of the pressure belt 15 that makes a contact with the recording medium is made of a conductive material.

A neutralizing charger 21 in a separating unit applies AC electric field to the pressure belt 15 and the recording medium 18 to neutralize the negative charge on the pressure belt 15 and the positive charge on the recording medium 18. Once the recording medium is neutralized, it can be easily separated from the pressure belt 15 and delivered into a delivery tray 22 by a curvature of the guide roller 17. As illustrated in FIG. 2, at downstream in the feeding direction, that is, at a side that the neutralizing charger 21 is provided, the pressure belt 15 extends longer than the fixing belt 13. Therefore, the recording medium 18 separates from these belts step-by-step. In other words, the recording medium, first, separates from the fixing belt 13, and then separates from the pressure belt 15. In such a structure, the recording medium separates easily compared to when it separates from these belts at the same time. This allows various layouts for placing the neutralizing charger (neutralizing unit) because the pressure belt 15, that is, the suctioning belt is provided at downstream in the feeding direction. When the pair of the belts has the same structure at a nip exit, these belts are piled up so that needs to be neutralized from a backside of the belt. This causes a few layouts for placing the neutralizing charger.

When a controlling temperature of the heating roller 11 is 105 degrees and a feeding speed is 200 millimeters per second (mm/sec), it is possible to feed the recording medium 18 smoothly at low torque, and a blur of an image is prevented so that an excellent image is obtained. That is, it is possible to fix the toner at a temperature as low as 105 degrees. Exemplary composition of the toner is as follows:

| | |
|---|---|
| cyclic isoprene | 70 wt %; |
| carnauba wax | 30 wt %; |
| carbon black | 10 parts by weight; |
| negative charge type charge controlling agent | 1 part by weight |

A softening point of the toner is at a temperature of 80 degrees, and a fixing lower limit temperature of the toner is at a temperature of 85 degrees.

Figure 3:
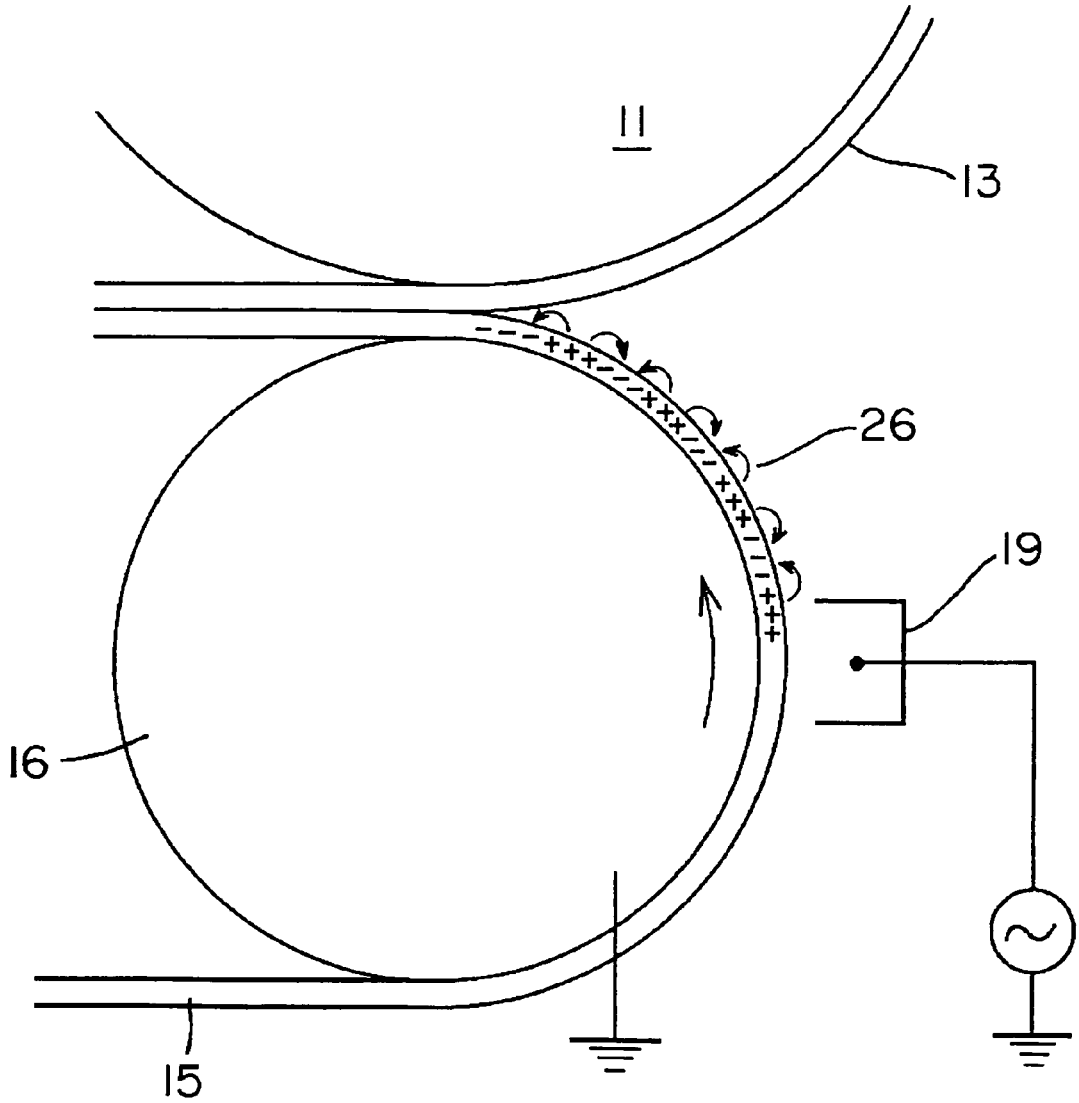
FIG. 3 is a partially enlarged view of a modification of the fixing device.

The charger 19 may be made to charge the pressure belt 15 by a charge of single-polarity or may be made to charge the pressure belt 15 by a charge of double-polarity. For example, as illustrated in FIG. 3, the charger 19 may be configured to apply AC voltage that has a frequency of 200 hertz to the pressure belt 15 to charge the pressure belt 15 by a charge of double-polarity (i.e., positive and negative). When the feeding speed is 200 mm/sec, a closed electric field that has a positive charge part and a negative charge part alternatively at every 1 mm is formed on the pressure belt 15. The closed electric field makes it possible to firmly hold even heaver recording medium such as a postcard. Even with this structure, the recording medium 18 can be feed smoothly, stably, and at low torque even if the controlling temperature of the heating roller 11 is as low as 105 degrees and a feeding speed to 200 mm/sec.

Figure 4:
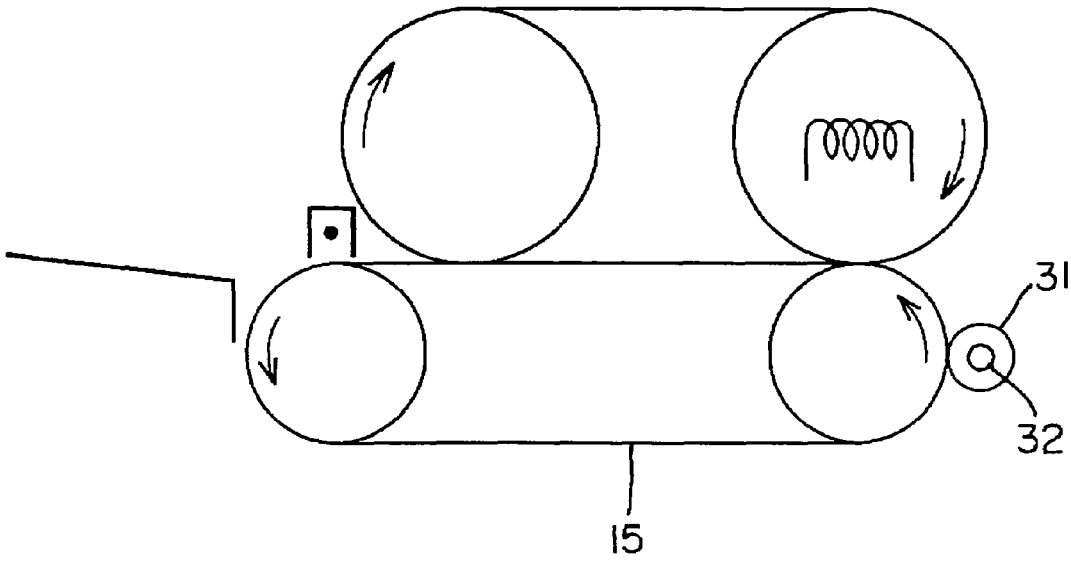
FIG. 4 is a schematic diagram of a fixing device according to another embodiment of the present invention.

FIG. 4 is a schematic diagram of the fixing device according to another embodiment of the present invention. In this embodiment, instead of the charger 19, a charging roller 31 that is in direct contact with a surface of the pressure belt 15 electrically charges the surface. The charging roller 31 is made of urethane rubber and the surface of the charging roller 31 is subjected to carbon dispersion to impart half-conductivity. When a spindle 32 of the charging roller 31 is applied a bias of minus 2 kilovolts to minus 3 kilovolts, the surface of the pressure belt 15 gets charged to an electrical potential of minus 500 volts to minus 1000 volts. Because the charging roller 31 and the pressure belt 15 are in direct contact, less ozone is produced. As a result, there is no need to provide an ozone filter. Even with this structure, the recording medium 18 can be feed smoothly, stably, and at low torque even if the controlling temperature of the heating roller 11 is as low as 105 degrees and a feeding speed to 200 mm/sec.

Figure 5:
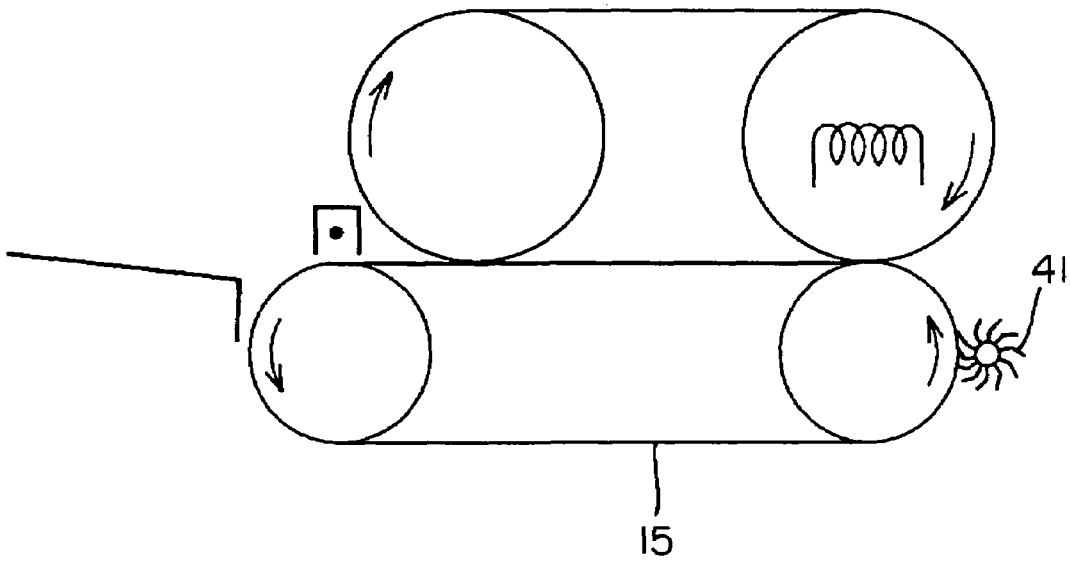
FIG. 5 is a schematic diagram of a fixing device according to still another embodiment of the present invention.

FIG. 5 is a schematic diagram of the fixing device according to still another embodiment of the present invention. In this embodiment, instead of the charger 19, a charging brush 41 that is in direct contact with a surface of the pressure belt 15 electrically charges the surface. The charging brush 41 is made of nylon fiber and the surface of the charging brush 41 is subjected to carbon dispersion to impart half-conductivity. When a spindle of the charging brush 41 is applied a bias of minus 2 kilovolts to minus 3 kilovolts, the surface of the pressure belt 15 gets charged to an electrical potential of minus 500 volts to minus 1000 volts. Because the charging brush 41 and the pressure belt 15 are in direct contact, less ozone is produced during charging. As a result, there is no need to provide an ozone filter. Even with this structure, the recording medium 18 can be feed smoothly, stably, and at low torque even if the controlling temperature of the heating roller 11 is as low as 105 degrees and a feeding speed to 200 mm/sec.

Figure 6:
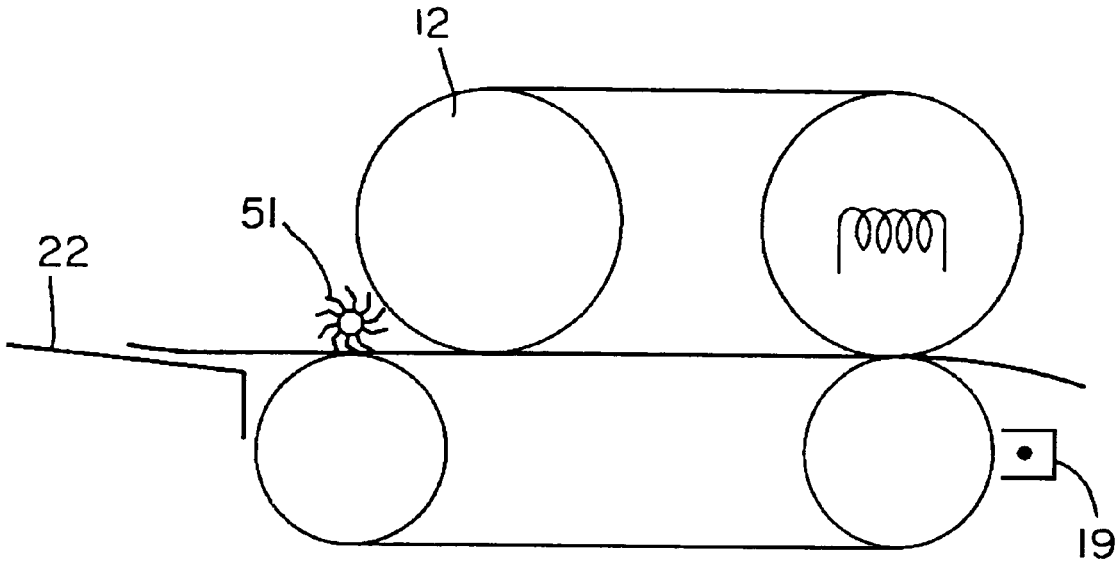
FIG. 6 is a schematic diagram of a fixing device according to still another embodiment of the present invention.

FIG. 6 is a schematic diagram of the fixing device according to still another embodiment of the present invention. This embodiment is different from that embodiment illustrated in FIG. 2 in that a neutralizing brush 51 is provided instead of the neutralizing charger 21. The neutralizing brush 51 applies AC electrical field from the side of the recording medium 18; therefore, the negative charge on the pressure belt and the positive charge on the recording medium are neutralized. In such a structure, the recording medium is separated from these belts by a curvature of the separating roller 12 and gravity of the recording medium 18, and is then delivered into the delivery tray 22. Because the neutralizing brush 51 and the recording medium are in direct contact, less ozone is produced during neutralizing. Moreover, in the same manner as in the other embodiments, even with this structure, the recording medium 18 can be feed smoothly, stably, and at low torque even if the controlling temperature of the heating roller 11 is as low as 105 degrees and a feeding speed to 200 mm/sec.

The present invention provides a fixing device in which the recording medium gets firmly and stably adhered to the pressure belt without increasing the torque. Moreover, because the recording medium is firmly and stably adhered to the pressure belt, an excellent image with no offset or no image blur can be obtained even if a toner having a low melting point is used. As a result, it enables to suppress energy consumption.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing device in an image forming apparatus, comprising:

a pressure belt that holds a recording medium by electrostatic force and carries the recording medium, the recording medium having a toner image on a surface that is not in contact with the pressure belt;

a fixing belt that fixes the toner image on the recording medium that is held by the pressure belt; and a charging unit that applies an AC voltage to the pressure belt such that alternating regions of the pressure belt have alternate electric charges, wherein the alternating regions alternate in a direction that the pressure belt advances.

2. The fixing device according to claim 1, further comprising:

a heating unit that heats the toner image on the recording medium while the fixing belt fixes the toner.

3. The fixing device according to claim 1, wherein the charging unit electrically charges the pressure belt before the recording medium makes a contact with the pressure belt.

4. The fixing device according to claim 1, wherein the charging unit electrically charges a surface of the pressure belt that makes a contact with the recording medium.

5. The fixing device according to claim 3, wherein the charging unit is an electric charger.

6. The fixing device according to claim 5, wherein the electric charger is in the form of a roller.

7. The fixing device according to claim 5, wherein the electric charger is in the form of a brush.

8. The fixing device according to claim 3, wherein a surface of the pressure belt that is charged by the charging unit is provided with a coating of an electric non-conductive material.

9. The fixing device according to claim 1, further comprising a neutralizing unit that neutralizes the electric charges on the pressure belt and the recording medium after the toner image has been fixed to the recording medium.

10. The fixing device according to claim 9, wherein the neutralizing unit is a neutralizing charger that applies an alternating voltage to the recording medium to neutralize the electric charges.

11. The fixing device according to claim 9, wherein the neutralizing unit is in the form of a brush.

12. The fixing device according to claim 1, wherein the pressure belt is configured to extend longer than the fixing belt in a direction of dispatch of the recording medium.

13. The fixing device according to claim 12, wherein the pressure belt tightly holds the recording medium.

14. The fixing device according to claim 1, wherein the fixing belt makes a contact with the toner image on the recording medium and the pressure belt does not make a contact with the toner image on the recording medium.

15. The fixing device according to claim 1, wherein the pressure belt is an endless belt and is rotatably suspended over a plurality of rollers.

16. The fixing device according to claim 1, wherein the fixing belt is an endless belt and is rotatably suspended over a plurality of rollers.

17. An image forming apparatus comprising a fixing device, the fixing device including, a pressure belt that holds a recording medium by electrostatic force and carries the recording medium, the recording medium having a toner image on a surface that is not in contact with the endless pressure belt;

a fixing belt that fixes the toner image on the recording medium that is held by the pressure belt; and a charging unit that applies an AC voltage to the pressure belt such that alternating regions of the pressure belt have alternate electric charges, wherein the alternating regions alternate in a direction that the pressure belt advances.

18. An image forming apparatus comprising a fixing device, the fixing device including, a pressure belt that holds a recording medium by electrostatic force and carries the recording medium, the recording medium having a toner image on a surface that is not in contact with the pressure belt;

a fixing belt that fixes the toner image on the recording medium that is held by the pressure belt; and a neutralizing unit that neutralizes electric charges on the pressure belt and the recording medium after the toner image has been fixed to the recording medium, wherein the neutralizing unit is a neutralizing charger that applies an alternating voltage to the recording medium to neutralize the electric charges.

19. A fixing device in an image forming apparatus, comprising:

a pressure belt that holds a recording medium by electrostatic force and carries the recording medium, the recording medium having a toner image on a surface that is not in contact with the pressure belt; and a fixing belt that fixes the toner image on the recording medium that is held by the pressure belt, and the pressure belt is configured to extend longer than the fixing belt in a direction of dispatch of the recording medium.

20. An image forming apparatus comprising a fixing device, the fixing device including, a pressure belt that holds a recording medium by electrostatic force and carries the recording medium, the recording medium having a toner image on a surface that is not in contact with the pressure belt; and a fixing belt that fixes the toner image on the recording medium that is held by the pressure belt, and the pressure belt is configured to extend longer than the fixing belt in a direction of dispatch of the recording medium.

* * * * *